United States Patent [19]

Bieltvedt et al.

[11] Patent Number: 4,964,523

[45] Date of Patent: Oct. 23, 1990

[54] PARTITIONED TRASH RECEPTACLE WITH FLAT AND ARCUATE SIDES

[75] Inventors: Arnor Bieltvedt; Louay Jeroudi; Lena Andersson; Sigurdur Agustsson, all of Providence, R.I.

[73] Assignee: Johnson & Wales University, Providence, R.I.

[21] Appl. No.: 445,807

[22] Filed: Nov. 20, 1989

[51] Int. Cl.[5] ..... B65D 25/04; B65D 25/16

[52] U.S. Cl. ..... 220/1 T; 220/22; 220/20; 220/DIG. 13; 220/404

[58] Field of Search ..... 220/1 T, 22, DIG. 13, 220/20; D34/1, 7, 8; D9/347, 341

[56] References Cited

U.S. PATENT DOCUMENTS

| | | | |
|---|---|---|---|
| D. 220,644 | 5/1971 | Robinson . | |
| D. 232,932 | 9/1974 | Stahel . | |
| 1,170,797 | 2/1916 | Burroughs . | |
| 3,648,875 | 3/1972 | Lundgren | 220/23.4 |
| 3,856,173 | 12/1974 | Deane | 220/23.83 |
| 3,904,218 | 9/1975 | Kostic | 220/23.4 |
| 4,114,776 | 9/1978 | Pluss | 220/22 |
| 4,589,570 | 5/1986 | Auten | 220/1 T |
| 4,863,053 | 9/1989 | Oberg | 220/1 T |
| 4,874,111 | 10/1989 | Heller | 220/22 |

*Primary Examiner*—Stephen Marcus
*Assistant Examiner*—S. Castellano
*Attorney, Agent, or Firm*—Salter & Michaelson

[57] ABSTRACT

A trash receptacle includes an upright open container member, a partition dividing the interior of the container member into first and second compartments and a cover member on the container member, the cover member having first and second access openings therein of circular and rectangular configuration, respectively, for passing recyclable and non-recyclable trash, respectively, into the first and second compartments, respectively. The container member includes an arcuate sidewall which defines the outer extremities of the first compartment and first and second substantially flat sidewalls which are disposed in angular relation to each other and define the outer extremeties of the second compartment.

4 Claims, 2 Drawing Sheets

PARTITIONED TRASH RECEPTACLE WITH FLAT AND ARCUATE SIDES

BACKGROUND AND SUMMARY OF THE INVENTION

The instant invention relates to trash receptacles and more particularly to a trash receptacle which is adapted to permit segregation of recyclable and non-recyclable trash.

The need for developing environmentally sound methods of disposing of trash has gained significant recognition in recent years. As a result, many communities have implemented trash disposal systems which require consumers to segregate recyclable and non-recyclable trash. However, in order to carry this out most households have found it necessary to maintain separate trash receptacles for recyclable and non-recyclable trash. For practical reasons, this has been found to be less than satisfactory in many cases. For example, the kitchen areas of many houses and apartments simply lack ample space to accommodate two separate trash receptacles. Further, it has been found that even when ample space is available, the practice of maintaining two trash receptacles is often aesthetically unacceptable. Accordingly, while the practice of recycling trash has been found to be environmentally sound, it has often been found to be difficult to implement.

The instant invention provides a unique trash receptacle which is adapted for aesthetically pleasing constructions and which enables users to simply and easily segregate recyclable and non-recyclable trash. Specifically, the instant invention provides a trash receptacle comprising a container member having a partition therein which divides the interior of the container member into first and second substantially upright compartments, and a cover member on the container member having first and second cover sections which substantially cover the upper ends of the first and second compartments, respectively. The first and second cover sections have first and second access openings, respectively, therein which are positioned to permit trash to be selectively passed therethrough into the first and second compartments, respectively, in the container member. The first cover section preferably has a plurality of access openings therein which are preferably of substantially circular configuration and the second cover section preferably has two enlarged access opening therein of substantially rectangular configuration. Further, the access openings in the first and second cover sections preferably include deflectable access opening flaps for normally covering the access openings. The container member preferably includes a pair of upstanding substantially flat sidewall portions which are disposed in substantially perpendicular relation with respect to each other and an upstanding arcuate sidewall portion which extends between the first and second substantially flat sidewall portions. The inner partition preferably extends from the intersection between the first substantially flat sidewall portion and the arcuate sidewall portion to the intersection between the second substantially flat sidewall portion and the arcuate sidewall portion. Further, the arcuate sidewall portion and the partition preferably cooperate to define the first compartment and the first and second substantially flat sidewall portions and the partition preferably cooperate to define the second compartment.

It has been found that the trash receptacle of the instant invention can be effectively and easily utilized for receiving and containing segregated recyclable and non-recyclable trash. Specifically, because the trash receptacle of the instant invention has separate access openings for the first and second interior compartments, one of the interior compartments can be utilized for containing recyclable trash while the other compartment is utilized for containing non-recyclable trash. Further, because the access openings in the first cover section are of substantially circular configuration, they are adapted for selectively receiving recyclable cans and bottles but not larger non-recyclable items. In addition, because the outer extremity of the first compartment is defined by an arcuate upstanding sidewall, the first compartment is readily recognizable as the compartment which is adapted for receiving recyclable materials through the circular access openings in the first cover section. Similarly, because the outer extremity of the second compartment is defined by a pair of substantially flat upstanding sidewalls and because the access openings in the second cover section are preferably of substantially rectangular configuration and of substantially larger dimension than the circular openings in the first cover section, the second compartment is readily recognizable as being adapted for receiving non-recyclable items of various sizes.

Devices representing the closest prior art to the subject invention of which the applicant is aware are disclosed in the Schaerer U.S. Pat. No. 4,750,639; Pender U.S. Pat. No. 4,739,894; Taylor U.S. Pat. No. 3,825,150; Schilling U.S. Pat. No. 1,203,056; Spencer U.S. Pat. No. D279,417; Culligan U.S. Pat. No. D242,423; Kenerson U.S. Pat. No. D223,956; Prager U.S. Pat. No. D208,833; and Martin et al, U.S. Pat. No. D199,710. However, since these references fail to suggest a trash receptacle having first and second compartments which are specifically adapted for receiving recyclable and non-recyclable materials, respectively, in the manner of the trash receptacle of the instant invention they are believed to be of only general interest with respect thereto.

Accordingly, it is a primary object of the instant invention to provide an effective trash receptacle which is adapted for effectively receiving and containing segregated recyclable and non-recyclable trash.

Another object of the instant invention is to provide an effective trash receptacle comprising a cover portion which includes a first section having a plurality of substantially circular openings therein for receiving recyclable trash items and a second section having a pair of enlarged openings therein for receiving non-recyclable trash items.

Another object of the instant invention is to provide a trash receptacle having a first compartment which is readily recognizable as being adapted for receiving recyclable items and a second compartment which is readily recognizable as being adapted for receiving non-recyclable items.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
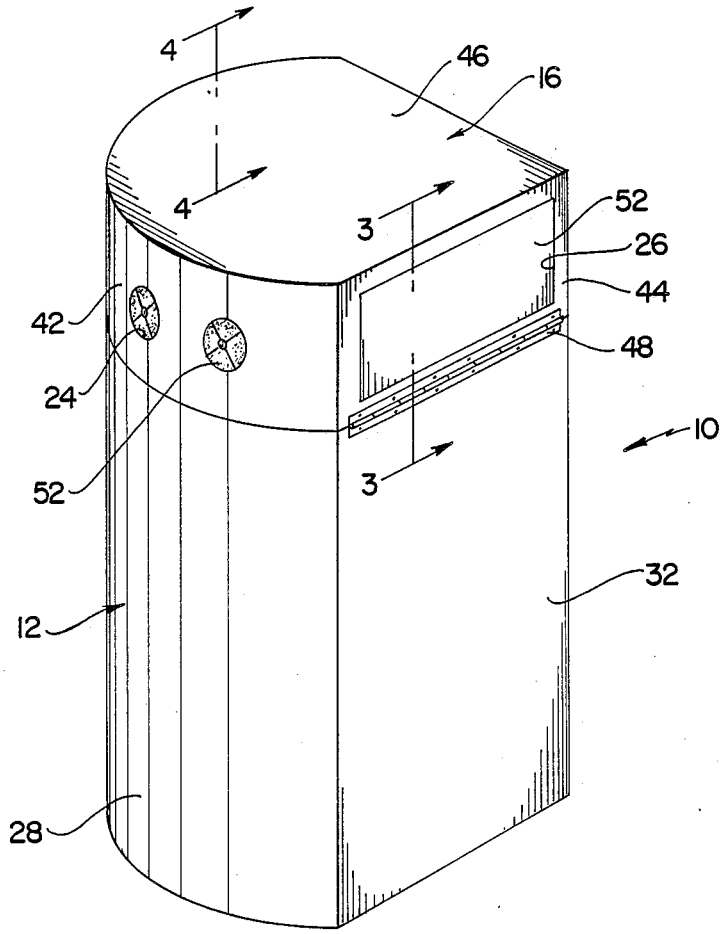
FIG. 1 is a perspective view of the trash receptacle of the instant invention.
Figure 2:
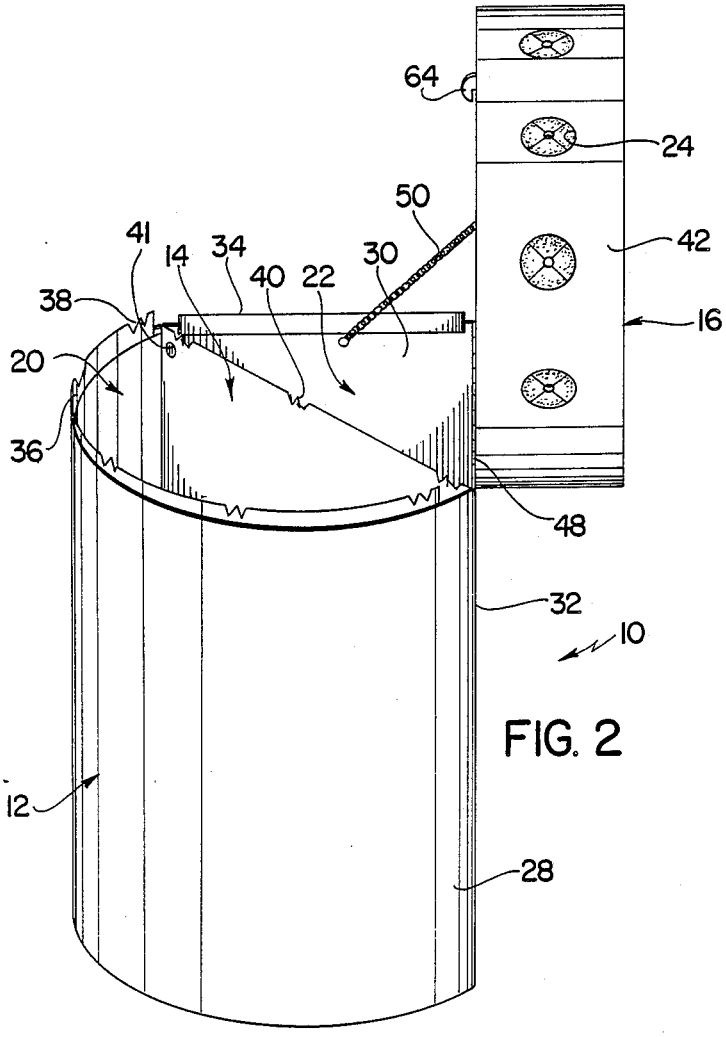
FIG. 2 is a side elevational view thereof.
Figure 3:
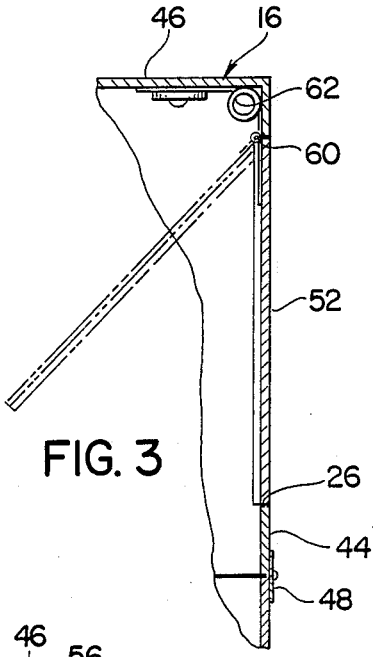
FIG. 3 is a fragmentary sectional view taken along line 3—3 in FIG. 1.

Referring now to the drawings, the trash receptacle of the instant invention is illustrated in FIGS. 1–4 and generally indicated at 10 in FIGS. 1 and 2. The trash receptacle 10 comprises a container member generally indicated at 12, an interior partition generally indicated at 14, a cover portion generally indicated at 16 and a latching mechanism generally indicated at 18. The container member 12 and the interior partition 14 cooperate to define first and second substantially upright interior compartments 20 and 22, respectively, which are adapted for receiving recyclable and non-recyclable trash, respectively. The cover portion 16 has a plurality of circular first access openings 24 therein which are adapted and positioned for passing recyclable trash into the first compartment 20 and a pair of enlarged, substantially rectangular second openings 26 therein which are adapted and positioned for passing non-recyclable trash into the second compartment 22.

The container member 12 is preferably made from a suitable rigid material, such as a suitable plastic and it includes an upstanding arcuate sidewall portion 28, first and second substantially flat upstanding sidewall portions 30 and 32, respectively, and a bottom wall portion (not shown). The first and second substantially flat sidewall portions 30 and 32, respectively, are preferably integrally joined to each other in substantially perpendicular relation and the arcuate sidewall portion 28 preferably extends integrally between the first and second sidewall portions 30 and 32, respectively, so that the first and second substantially flat sidewall portions 30 and 32, respectively, and the arcuate sidewall portion 28 cooperate to define the outer periphery of the container member 12. An upper lip 34 projects upwardly slightly from the inner side of the first substantially flat sidewall portion 30 and an arcuate upper lip 36 having a plurality of upwardly facing tangs 38 thereon projects upwardly slightly from the inner side of the arcuate sidewall portion 28 as illustrated.

The partition 14 is illustrated most clearly in FIG. 1 and it comprises a substantially flat upstanding wall which is preferably made from a suitable, substantially rigid plastic material. The partition 14 has a plurality of tangs 40 formed along the upper edge thereof and it is assembled with and secured to the container member 12 so that it extends between the intersections of the arcuate sidewall portion 28 with the first and second substantially flat sidewall portions 30 and 32, respectively. An aperture 41 is formed in the partition 14 adjacent to the upper edge thereof proximal the intersection between the arcuate sidewall portion 28 and the first substantially flat sidewall portion 30.

The cover member 16 is dimensioned and configured to be received in substantially covering relation on the container member 12 and it includes an arcuate sidewall portion 42, first and second substantially flat sidewall portions 43 and 44, respectively, and a substantially flat top wall portion 46. The second substantially flat cover member sidewall portion 44 is hingeably attached to the second substantially flat container member sidewall portion 32 with a hinge 48 in order to hingeably attach the cover member 16 to the container member 12. Accordingly, the cover member 16 is hingeable between the open position illustrated in FIG. 2 and the closed position illustrated in FIG. 1. A retaining chain 50 extends between the first substantially flat container member sidewall portion 30 and the first substantially flat cover member sidewall portion 43 for limiting the extent to which the cover member 16 can be opened. A plurality of the substantially circular first access openings 24 is formed in the arcuate cover member sidewall portion 42 and, as illustrated most clearly in FIG. 4, each of the first access openings 24 is covered by a deflectable flap 52. Each of the flaps 52 is preferably made from a suitable resilient elastomeric material and each flap 52 has a central aperture 54 therein and a plurality of slits 56 which radiate outwardly from the aperture 54 therein to permit various portions of the flaps 52 to be deflected inwardly. Each of the flaps 52 is retained by a retainer plate 58 which is secured on the inner side of the arcuate cover member sidewall portion 42 as illustrated. A single second access opening 26 is formed in each of the substantially flat cover member sidewall portion 43 and 44. Each of the second access openings 26 is of substantially rectangular configuration and of substantially greater dimension than each of the first access openings 24. A substantially rigid flap 52 which is preferably made from a suitable plastic material is hingeably attached to each of the first and second cover member sidewall portions 43 and 44, respectively, with a hinge 60 so that it is inwardly deflectable to the position illustrated in FIG. 3 for passing trash into the compartment 22 through the respective second access opening 26 thereof. A pair of springs 62 is attached to the top wall portion 46 of the cover member 16 for returning the flaps 52 to closed positions.

Figure 5:
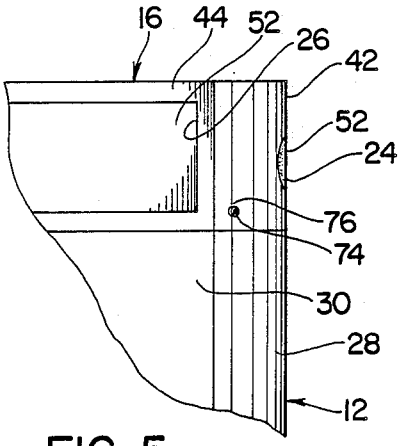
FIG. 5 is a fragmentary side elevational view of the trash receptacle.
Figure 4:
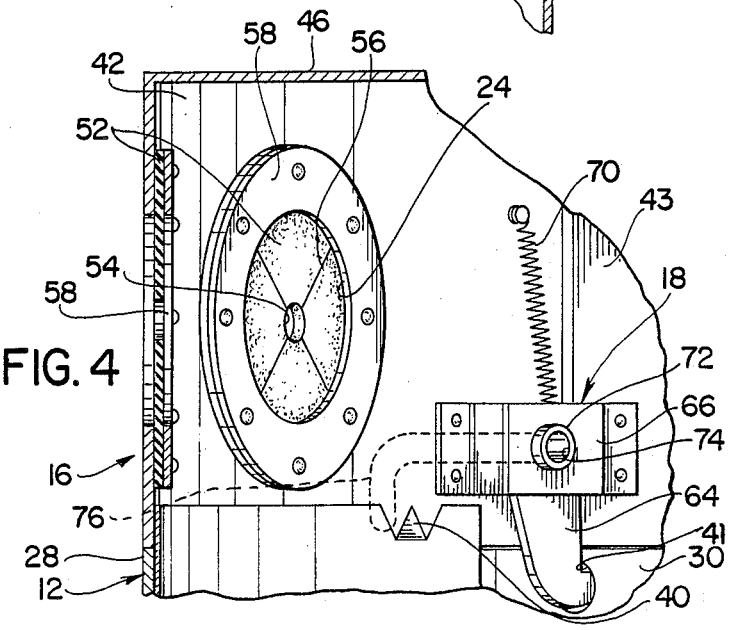
FIG. 4 is a fragmentary sectional view taken along line 4—4 in FIG. 1.

The latch assembly 18 is illustrated in FIGS. 4 and 5 and it is operative for releasably retaining the cover member 16 in a closed position on the container member 12. The latch assembly 18 includes a latch arm 64 which is pivotally mounted on the inner side of the container member 16 with a bracket 66. The latch arm 64 is positioned and configured so that it is receivable in engagement in the aperture 41 for retaining the cover member 16 in a closed position and a spring 70 is provided for retaining the latch arm 64 in a position of engagement in the aperture 41. Integrally formed with the latch arm 64 is a boss 72 which projects outwardly slightly through the arcuate sidewall portion 42 of the cover member 16 and a hexagonal aperture 74 extends through the boss 72. A hexagonal key 76 which is receivable in the aperture 74 is provided for pivoting the latch arm 76 to a position of disengagement from the aperture 41 to enable the cover member 16 to be hinged to the open position thereof illustrated in FIG. 2.

Accordingly, for use and operation of the trash receptacle 10 separate trash bags are preferably placed in the first and second compartments 20 and 22, respectively, so that they are retained in position by the tangs 38 and 40. The cover member 16 is then moved to a closed position to further retain the trash bags in the compartments 20 and 22. Thereafter, recyclable trash may be passed through one of the apertures 24 so that it falls into the bag in the first compartment 20. Similarly, non-recyclable trash can be passed through one of the apertures 26 by deflecting the flap 52 thereof inwardly so that the non-recyclable trash falls into the bag in the second compartment 22. The overall rounded configuration of the portion of the receptacle 10 which is adapted to receive recyclable materials and the overall "semi-rectangular" configuration of the portion of the receptacle 10 which is adapted to receive non-recyclable materials makes it easy to distinguish between the various portions of the receptacle 10 so that only recyclable materials are passed into the first compartment 20 and only non-recyclable materials are passed into the second compartment 22. The configurations and relative sizes of the openings 24 and 26 further assures that only recyclable and non-recyclable materials are passed into the compartments 20 and 22, respectively.

It is seen therefore that the instant invention provides an effective receptacle for receiving and containing segregated recyclable and non-recyclable trash. The configuration of the receptacle 10 and the configurations and dimensions of the openings 24 and 26 make it simple and convenient for users to recognize and distinguish between the different portions of the receptacle 10 in order to effectively segregate recyclable and non-recyclable trash. Further, because of the overall configuration of the receptacle 10 it can be easily accommodated in most kitchen areas. Accordingly, for these reasons as well as the other reasons hereinabove set forth, it is seen that the trash receptacle of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A trash receptacle comprising a substantially upright container member having a substantially open upper end, partition means in said container member dividing it into first and second substantially upright compartments, said compartments having substantially open upper ends, and cover means on said container member, said cover means including first and second cover means sections which substantially cover the upper ends of said first and second compartments, respectively, said first and second cover means sections having first and second access openings therein, respectively, for passing trash into said first and second compartments, respectively, said container member including first and second upstanding substantially flat sidewall portions which are disposed in substantially perpendicular relation with respect to each other and an arcuate upstanding sidewall portion extending between said first and second substantially flat upstanding sidewall portions, said arcuate sidewall portion defining the outer extremity of said first substantially upright compartment, said first and second substantially flat sidewall portions defining the outer extremity of said second substantially upright compartment.

2. In the trash receptacle of claim 1, said first and second access openings being substantially circular and substantially rectangular, respectively.

3. In the trash receptacle of claim 2, said first cover means section having a plurality of said substantially circular first access openings therein.

4. In the trash receptacle of claim 2, each of said first access openings having a substantially smaller area than said second access opening.

* * * * *